US005117660A

United States Patent [19]

Downs et al.

[11] Patent Number: 5,117,660

[45] Date of Patent: Jun. 2, 1992

[54] APPLIANCE WASTE WATER DROUGHT RELIEF SYSTEM

[76] Inventors: Dennis J. Downs, 1217 F St., Sacramento, Calif. 95814; Jeffrey C. Coburn, P.O. Box 408, Tahoma, Calif. 95733

[21] Appl. No.: 696,031

[22] Filed: May 6, 1991

[51] Int. Cl.[5] ..... D06F 39/08; E03C 1/122

[52] U.S. Cl. ..... 68/208; 4/665; 134/104.2; 134/115 R; 137/883; 239/200; 239/447

[58] Field of Search ..... 68/208, 232, 902; 134/104.2, 115 R; 137/883; 239/200, 201, 447; 4/663, 664, 665; 210/424

[56] References Cited

U.S. PATENT DOCUMENTS

| | | | |
|---|---|---|---|
| 2,604,497 | 7/1952 | Morrison | 68/902 |
| 2,811,982 | 11/1957 | De Young | 137/883 X |
| 4,039,005 | 8/1977 | Clifford | 137/883 |
| 4,162,218 | 7/1979 | McCormick | 4/663 X |

FOREIGN PATENT DOCUMENTS

| | | | |
|---|---|---|---|
| 851864 | 10/1960 | United Kingdom | 68/902 |

*Primary Examiner*—Philip R. Coe
*Attorney, Agent, or Firm*—Richard C. Litman

[57] ABSTRACT

A drought relief system employs waste water as normally discharged from an appliance into a plumbing drain. A dual valve assembly is mounted in series within an existing appliance discharge line, usually exteriorly of the appliance and includes a first valve allowing for the distribution of waste water to the normal discharge line. By shutting off this first valve and opening a second valve, waste water is directed into a drought diversion conduit passing through the building wall and communicating with an appropriate distribution line. The latter may comprise a single conduit or a manifold network of conduits such as perforated pipes or hoses and thus permits utilization of water that otherwise would be discharged into the user's septic system or municipal waste system.

9 Claims, 1 Drawing Sheet

APPLIANCE WASTE WATER DROUGHT RELIEF SYSTEM

FIELD OF THE INVENTION

This invention relates generally to drought relief and more particularly, to an improved apparatus enabling the selective diversion of waste water from an appliance, either to a conventional waste pipe or to fluid distribution means exterior of the building enclosure containing the appliance.

BACKGROUND OF THE INVENTION

During the operation of various household appliances such as clothes washers and dishwashers, all water as discharged from the machine following its numerous cycles, is normally directed through a single discharge line leading to a drain connected to the household waste pipe system. This latter system may be a septic system or, a municipal waste water system. In the case of a clothes washer, a flexible plastics or rubber discharge pipe having a curved distal portion is normally provided with the machine as manufactured and in use, the machine water pump cyclically pumps all waste water through this discharge pipe. In most instances, the pipe distal portion directs this waste water into a washtub located adjacent the appliance and thus, all waste water is lost from any further beneficial use. With some washing machines, provision is made to permit re-use of the water as discharged during certain cycles. This is accomplished by pumping the water into the washtub with its drain blocked and thereafter, the same water is drawn back into the machine. However, in the end, all waste water is allowed to pass into the usual waste drain.

Dishwashers are another example wherein a large quantity of waste water is generated and is normally lost from any further beneficial use as it is directed into the drain line or food disposer unit of an adjacent kitchen sink. With either of the above types of appliances or any other type wherein waste water is generated and normally discharged into a building's waste drain system, it would greatly enhance water conservation if an apparatus were provided whereby a user may readily adapt the appliance to permit the selective distribution of the machine's water output to means serving to alleviate drought conditions. Even if there is no present drought alert situation, it may be desirable to utilize appliance waste water to at least improve the local water table versus directing the used water into the building's waste water system.

DESCRIPTION OF THE RELATED ART

The provision of alternative or supplemental waste water lines in washing machines is generally known. U.S. Pat. No. 2,701,582 issued to Graham et al discloses three water lines exteriorly of an appliance but which are employed to enable a re-cycling of spent soapy water between the machine and a tub. U.S. Pat. No. 2,923,144 issued to Smith teaches a pair of waste water lines issuing from a washing machine but wherein both are joined to an electrically actuated valve associated with the pump within the machine. With the Smith arrangement, one line is used to deliver waste water to a drain while the other serves to permit recycling of soapy water between a tub and the machine. None of the above prior art is seen to suggest the instant system wherein drought relief is provided to an outdoors environment by a user manually re-directing appliance waste water from a building drain system by manipulating a dual valve unit to deliver the waste water through a building wall to a distribution system outdoors.

SUMMARY OF THE INVENTION

By the present invention, an improved user installable waste water utilization system is offered wherein a dual valve unit is inserted in series within the existing water discharge line of an appliance. By manipulating the two valves a user may selectively direct water from the appliance to either the usual building waste drain system or alternatively, to a water diversion line passing through the building wall and which communicates with a water distribution line or lines serving to deliver the water to the soil. In this manner, water as consumed by the user is conserved and drought conditions are relieved since gardens, lawns or flower borders may be supplied with moisture without having to consume other water from a hose bib. Such an arrangement is particularly useful when a drought alert is posted and homeowners are prohibited from outside watering. During such situations, appliance usage is still permitted and with the instant apparatus, waste water that would otherwise be lost is conserved by being put to beneficial use.

Accordingly, one of the objects of the present invention is to provide an improved drought relief system including a valve and conduit apparatus permitting the selective direction of waste water from an appliance either to a conventional building waste water drain or, to a water distribution line located exteriorly of the building.

Another object of the present invention is to provide an improved drought relief system including a user installable dual valve unit insertable in series within the existing water discharge line of an appliance.

Still another object of the present invention is to provide an improved drought relief system including an alternative valve unit within the water discharge line of an appliance and which includes a water diversion line passing through the building to the outside and which connects with a water distribution line(s) serving to irrigate a lawn, garden, flower beds or the like.

With these and other objects in view which will more readily appear as the nature of the invention is better understood, the invention consists in the novel construction, combination and assembly of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
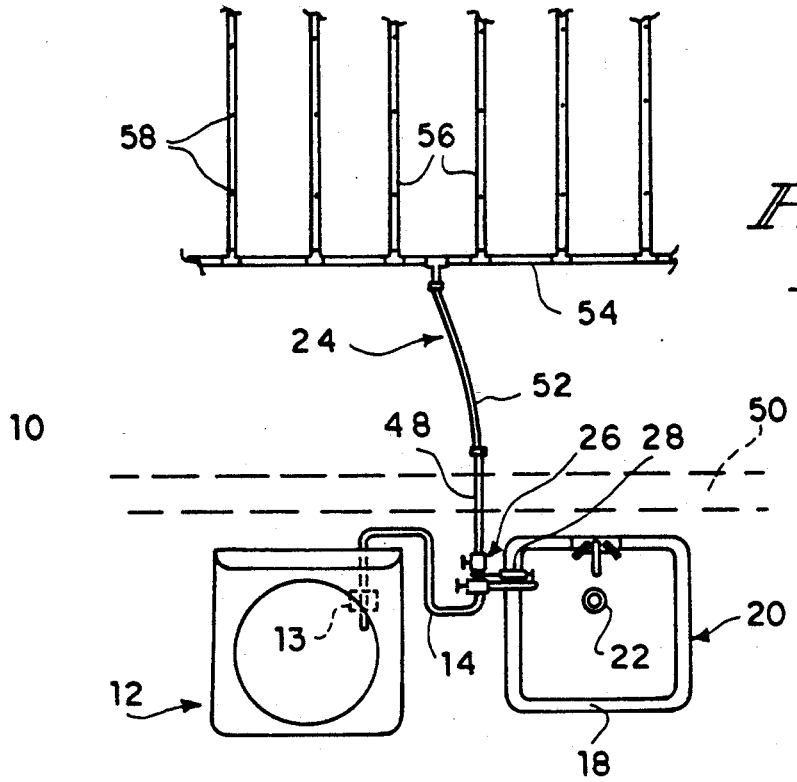
FIG. 1 is a top plan of the present system as utilized with a clothes washing machine.

Referring now to the drawings, particularly FIG. 1, the present invention will be understood to relate to a drought relief system generally designated 10 and which is intended to utilize the waste water as discharged from any one of several types of water consuming appliances. Although a clothes washing machine 12 is shown in the drawings, the instant system will be just as useful with other types of appliances having a waste water discharge line, such as dishwashers (not shown).

Following the various wash, spin and rinse cycles of the typical appliance 12, the waste water normally is directed from the machine, by means of a pump 13, through a discharge line 14 extending exteriorly of the machine and having a distal fitting 16 adapted to be disposed over the lip 18 of an adjacent wash tub 20, wherein the water passes into the building waste water system through the tub drain 22. With the present system, any or selected portions of this appliance waste water may be alternately directed to either the tub drain 22 or, to a drought relief water distribution assembly 24 located exteriorly of the building. To accomplish the foregoing, a dual valve unit 26 is placed in series within the appliance discharge line 14, intermediate the appliance 12 and the distal discharge fitting 16. The location of this valve unit 26 is selected to insure its ready accessibility to a user. As shown in FIG. 1, the valve unit is positioned adjacent the tub lip 18 and secured thereto, as by the clamp device 28 and thus will be located substantially at a user's waist level where it will be convenient for one to reach and manipulate.

Figure 2:
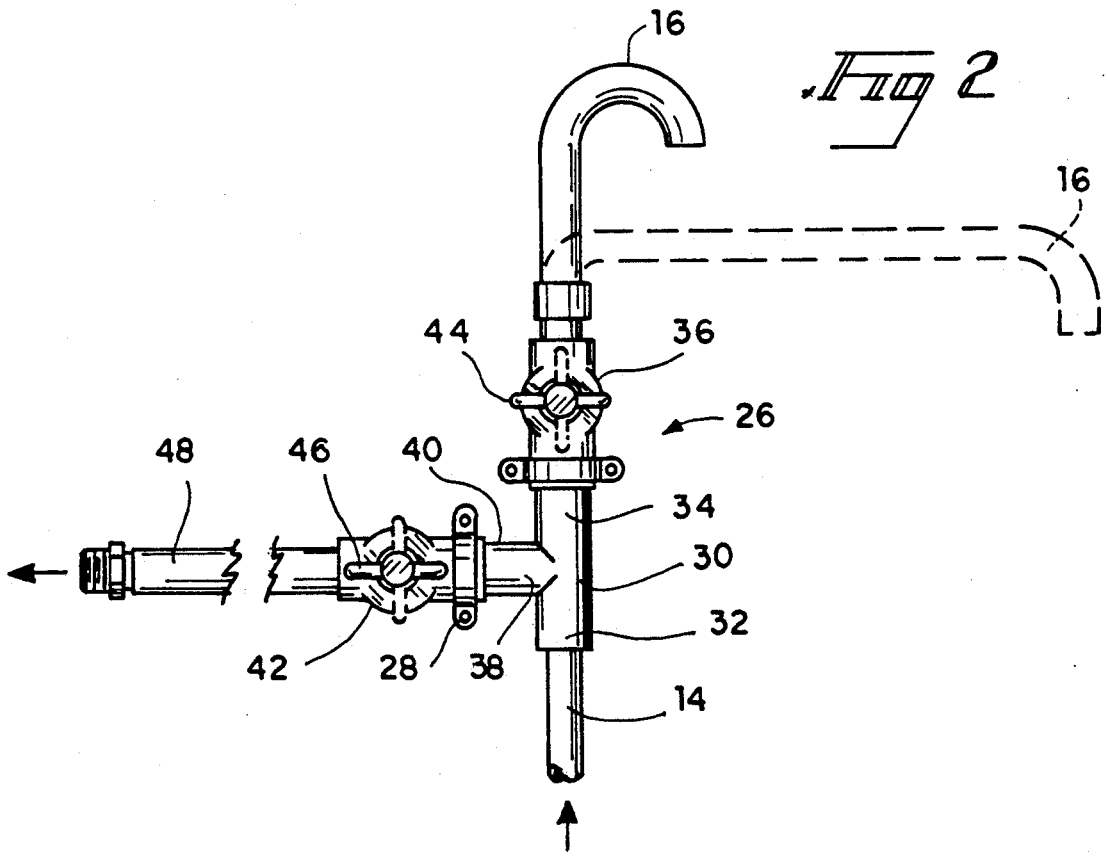
FIG. 2 is an enlarged side elevation of the valve unit and conduits as shown in FIG. 1.

The valve unit 26 may assume any of several configurations but preferably includes a T-fitting having a vertical portion 30 provided with a lower inlet 32 and an opposite, upper first outlet 34. It is this vertical portion 30 that is placed in line within the appliance discharge line 14 and this is accomplished by cutting the line 14 if necessary and joining it to the valve unit lower inlet 32. The unit 26 includes a first outlet valve 36 which is connected to the fitting first outlet 34 while the distal, waste water discharge fitting portion 16 is then connected to the first outlet valve 36, as shown most clearly in FIG. 2. With the distal fitting 16 extending into a tub 20 or the like having a drain 22 leading to the building waste water drain, it will be seen that by manipulating the valve 36, the flow of waste water from the appliance 12 may be alternately directed to the drain 22 or, blocked from passing to the fitting 16.

The horizontal portion 38 of the T-fitting 26 provides a second outlet 40 to which is attached a second outlet valve 42. When the first valve is turned off as in the full line position of the handle 44 shown in FIG. 2 and the handle 46 of the second outlet valve 42 is opened as in the illustrated full line position, waste water as pumped into the appliance discharge line 14, will be directed through the second outlet valve 42 and into a through-wall pipe or conduit 48. This conduit passes through the building wall 50 to the outdoors and there, is connected to the drought water relief assembly 24.

The assembly 24 may comprise a single hose or pipe or, a multiple number of lines arranged according to the terrain or desires of the user. For example, a primary distribution line 52 may supply waste water from the conduit 48 to a manifold line 54 which in turn may supply a plurality of feeder hoses 56 as depicted in FIG. 1. At the point where it is desired to deposit the water as conveyed by the lines 52, 54 and 56, the terminus of the lines 56 may either be open or, they may be plugged and the lines 56 may be perforated as at 58 to allow for a more even distribution of the water. In this latter respect, the lines 56 may be either rigid pipe or flexible soaker hoses.

The operation of the present system should be obvious from the above description. When a user of the appliance 12 desires to direct the machine's discharged water to the drought relief assembly 24, the first outlet valve 36 is manipulated to shut it off thereby precluding the flow of water to the discharge fitting 16. At the same time, the second outlet valve 42 is opened so that all water as pumped from the appliance discharge line 14 is directed into the through wall conduit 48 and thence to the irrigation lines outdoors. At any point, the waste water flow may be directed for distribution through the discharge fitting 16 and into the building drain system, by changing the above settings of the two valves 36,42.

It is to be understood that the present invention is not limited to the sole embodiment described above, but encompasses any and all embodiments within the scope of the following claims.

We claim:

1. A drought relief system comprising the combination;

a washing machine having a pump connected to a water discharge line including an exterior portion disposed exteriorly of the washing machine, comprising;

a dual valve unit including a fitting having first and second fluid passage portions, said first portion provided with an inlet and outlet with said inlet connected to said discharge line exterior portion, said second portion communicating with said first portion and having an outlet, a first outlet valve connected to said first portion outlet, a second outlet valve connected to said second portion outlet, a distal discharge fitting joined to said first outlet valve for delivering water from said washing machine to a building waste water drain, a conduit connected to said second outlet valve and passing from interiorly of a building to its exterior, and said conduit communicating with a water distribution line disposed exteriorly of the building, whereby said first and second outlet valves may be respectively opened and closed to direct water pumped from said washing machine into said discharge line and thence alternately, into said distal discharge fitting and said water distribution line.

2. A drought relief system according to claim 1 wherein, said washing machine comprises a clothes washer.

3. A drought relief system according to claim 1 wherein, said washing machine comprises a dishwasher.

4. A drought relief system according to claim 1 wherein, said dual valve unit first and second fluid passage portions define a T-fitting.

5. A drought relief system according to claim 1 including, a wash tub disposed adjacent said washing machine, clamp means attaching said dual valve unit to said wash tub, and a drain in said wash tub communicating with said building waste water drain.

6. A drought relief system according to claim 1 including, a feeder line communicating with said water distribution line.

7. A drought relief system according to claim 6 wherein, said feeder line includes an elongated member having a plurality of holes therethrough.

8. A drought relief system according to claim 1 wherein, said dual valve unit first portion is disposed vertically, and said dual valve unit second portion communicating with said first portion and disposed horizontally.

9. A drought relief system according to claim 1 including, a manifold line communicating with said water distribution line, and a plurality of feeder lines communicating with said manifold line.

* * * * *